United States Patent [19]

Sorensen

[11] 4,363,943

[45] Dec. 14, 1982

[54] INTERVAL TIMER

[75] Inventor: Egon Sorensen, Cheyenne, Wyo.

[73] Assignee: AMF Incorporated, White Plains, N.Y.

[21] Appl. No.: 314,272

[22] Filed: Oct. 23, 1981

Related U.S. Application Data

[63] Continuation of Ser. No. 127,694, Mar. 6, 1980, abandoned.

[51] Int. Cl.[3] ..... H01H 43/10

[52] U.S. Cl. ..... 200/38 R; 200/38 BA; 200/38 CA; 200/38 D

[58] Field of Search ..... 200/38 B, 38 BA, 38 C, 200/38 CA, 38 D, 38 DA, 38 DB, 38 DC

[56] References Cited

U.S. PATENT DOCUMENTS 1,882,495 10/1932 Hipp ..... 200/38 DA 2,380,969 8/1945 King ..... 74/568 T X 3,588,391 6/1971 Banathy et al. ..... 200/38 D X 3,588,396 6/1971 Fredell ..... 200/38 CA

FOREIGN PATENT DOCUMENTS 1951874 4/1971 Fed. Rep. of Germany ..... 200/38 CA

*Primary Examiner*—J. R. Scott

*Attorney, Agent, or Firm*—David E. Dougherty; Charles J. Worth

[57] ABSTRACT

An interval timer has a cross-shaped cam with elongated arms and is interposed between a slot moving disc and a micro-switch. Adjustable pins are disposed on the outer extremities of the disc and engage the inner ends of the cross-shaped cam arms. The outer ends of the arms rotate with increased velocity causing rapid momentary actuation of the switch.

3 Claims, 2 Drawing Figures

INTERVAL TIMER

This is a continuation of application Ser. No. 127,694, filed Mar. 6, 1980 now abandoned.

BACKGROUND OF THE INVENTION

This invention relates to an interval timer, and more particularly, to simplified mechanism between a slow moving timer motor and micro-switch to momentarily operate the latter.

In the prior art complicated mechanisms are required in order to obtain momentary operation of a micro-switch off a slow moving timer moter. In my invention I do this in a low cost manner involving a minimum number of parts, and also make it possible to readily make adjustments.

BRIEF DESCRIPTION OF THE DRAWINGS

One form is illustrated in the attached sheet of drawing in which.

BRIEF DESCRIPTION OF THE PREFERRED EMBODIMENTS

Figure 1:
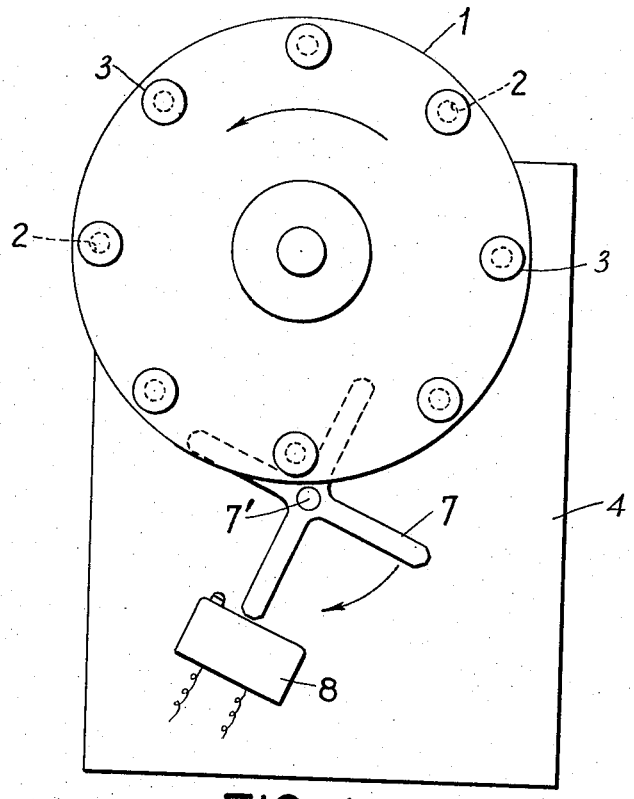
FIG.1 is a top plan illustration of the invention.
Figure 2:
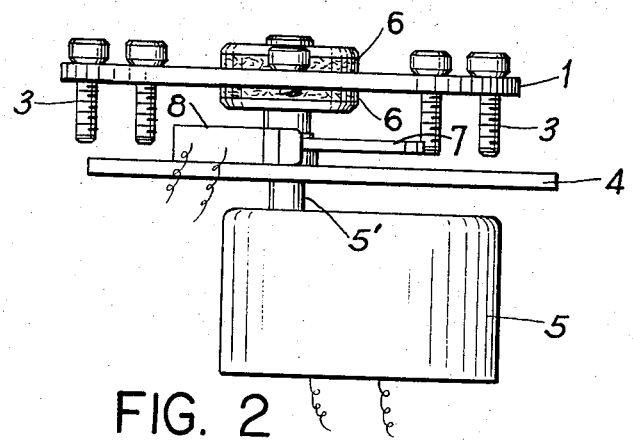
FIG. 2 is a side elevation view thereof.

In the drawing part 1 is a slow counterclockwise rotating circular disc having spaced holes 2 along its outer periphery Holes 2 are adapted to have pins 3 selectively positioned therein. Part 4 is a stationary mounting plate having a slow counterclockwise rotating timer motor 5 beneath it. The motor 5 has a shaft 5' extending through plate 4 to the disc 1 and is drive connected thereto by a pair of friction plates 6. This is for purposes of being able to circularly adjust the position of the disc 1 on the shaft 5'.

A cross-shaped cam 7 having a small hub and very long arms is interposed between the disc 1 and a micro-switch 8 or the like which is intended to be operated only momentarily off the slow timer motor 5, which might have a speed of 1 revolution every 24 hours. The cam 7 is rotatably mounted at its hub on a shaft 7' affixed in the plate 4.

In operation, the cam 7 is turned clockwise by the disc 1. As the disc 1 rotates the pins 3 move slowly past the cam 7. However, the pins 3 engage the cam 7 along its small hub at the inner ends of the perpendicularly crossed long arms of the cam, whereas it's the outer ends or extremeties of the arms that sweep by the switch 8. This difference means that the outer ends of the cam arms are moved at a far greater or increased angular velocity as compared to the inner ends of the arms. In this manner switch 8 is operated only for a moment or short interval even though the timer motor 5 and its disc 1 are very slow moving.

It will now be seen that in the invention something is initiated (micro-switch) for a very short interval off a slow moving drive (timer motor), and this is accomplished with a minimum number of parts and therefore at very low cost. In addition, the system is capable of adjustment. For example, the circular position of the disc 1 relative the motor can be adjusted because of the friction discs 6, and any number of holes or pins can be placed in the disc 1 at any desired spacing to get almost any sequence of operation that may be desired.

I claim:

1. A momentary interval timer comprising a base plate;

drive means mounted on one side of the said plate and having a rotatable shaft extending therefrom through said plate;

a device to be momentarily operated being mounted on said plate on the side opposite from said drive means;

a disc disposed on the side of said plate opposite from said drive means and connected to said shaft for rotation of said disc by said drive means;

said disc having a plurality of holes therethrough disposed in an equally spaced series adjacent the outer periphery of said disc;

cam means rotatably mounted between said disc and said device on the side of said plate opposite from said drive means;

said cam means having a hub adjacent the periphery on said disc and an equally spaced series of opposed elongated arms radiating from said hub.

said arms moving between said disc and said plate as said cam means is rotated and the free ends of said arms momentarily actuating said device as they rapidly pass thereby; and a plurality of pins selectively positioned in said holes and extending through said disc toward said plate;

said pins being moved relatively slowly along a circular path by said rotating disc each engaging adjacent said hub the arm of said cam extending between said disc and said plate thereby rotating said cam and causing the tip of said arm opposite from said engaged arm to move relatively rapidly by and momentarily actuate said device.

2. The momentary interval timer in accordance with claim 1, and said drive means being a constant speed timer motor;

said device being a microswitch; and the operating interval being determined by the number and location of said pins and the rotational speed of said disc.

3. The momentary interval timer in accordance with claim 2, and friction means drivingly connecting said disc to said shaft.

* * * * *